US006142108A

United States Patent [19]

Blichmann

[11] Patent Number: 6,142,108

[45] Date of Patent: Nov. 7, 2000

[54] TEMPERATURE CONTROL SYSTEM FOR USE WITH AN ENCLOSURE WHICH HOUSES AN INTERNAL COMBUSTION ENGINE

[75] Inventor: John R. Blichmann, Lafayette, Ind.

[73] Assignee: Caterpillar Inc., Peoria, Ill.

[21] Appl. No.: 09/212,790

[22] Filed: Dec. 16, 1998

[51] Int. Cl.[7] ..... F01P 7/02

[52] U.S. Cl. ..... 123/41.05; 123/41.06

[58] Field of Search ..... 123/41.04, 41.05, 123/41.06

[56] References Cited

U.S. PATENT DOCUMENTS

| | | | |
|---|---|---|---|
| 2,407,184 | 9/1946 | Sparrow | 137/139 |
| 2,413,770 | 1/1947 | Knoy | 123/174 |
| 3,155,082 | 11/1964 | Roorda et al. | 123/41.05 |
| 3,901,310 | 8/1975 | Strawn | 165/22 |
| 4,157,112 | 6/1979 | Swiderski | 165/2 |
| 4,476,820 | 10/1984 | Nixon | 123/41.05 |
| 4,779,577 | 10/1988 | Ritter et al. | 123/41.05 |
| 4,924,826 | 5/1990 | Vinson | 123/195 C |
| 5,036,803 | 8/1991 | Nolting et al. | 123/41.05 |
| 5,669,311 | 9/1997 | Hill et al. | 105/62.2 |

*Primary Examiner*—John Kwon
*Attorney, Agent, or Firm*—Taylor & Aust, PC

[57] ABSTRACT

A temperature control system includes an enclosure having a plurality of adjoining walls. An inlet louver assembly is disposed within one of the walls, and includes a plurality of inlet louvers. An outlet louver assembly is disposed within an other of the walls, and includes a plurality of movable outlet louvers. An actuator is coupled with the outlet louver assembly for moving the plurality of outlet louvers. An internal combustion engine is disposed within the enclosure. An ambient air temperature sensor is disposed within the enclosure for sensing an ambient air temperature within the enclosure and providing an output signal. An engine temperature sensor is coupled with the engine for sensing a temperature within the engine and providing an output signal. An electrical processing circuit is coupled with each of the ambient air temperature sensor, the engine temperature sensor and the actuator. The electrical processing circuit controls the actuator and thereby the movement of the plurality of outlet louvers dependent upon the output signal from each of the ambient air temperature sensor and the engine temperature sensor.

8 Claims, 2 Drawing Sheets

TEMPERATURE CONTROL SYSTEM FOR USE WITH AN ENCLOSURE WHICH HOUSES AN INTERNAL COMBUSTION ENGINE

TECHNICAL FIELD

The present invention relates to a temperature control system for use with an internal combustion engine, and, more particularly, to a temperature control system for use with an enclosure housing an internal combustion engine.

BACKGROUND ART

An internal combustion engine may be located within an enclosure during operation. For example, an internal combustion engine which is part of an electrical generator set may be located within a room of an enclosure. Such an engine is typically a liquid cooled engine which is connected with a radiator for cooling the liquid coolant during use. Conventionally, the radiator is located in the same room as the engine. A fan driven by the engine draws outside ambient air through the room and discharges the ambient air to the outside environment.

An enclosure for an internal combustion engine as described above may also be employed in cold environments where the outside air temperature is very cold. It is preferable to maintain the ambient air temperature within the enclosure at an elevated temperature relative to the outside ambient environment for more efficient operation of the engine and/or comfort to operating personnel within the enclosure. It is known to provide a separate room adjacent to the enclosure which houses the radiator connected with the internal combustion engine. The room which houses the internal combustion engine therefore only needs to draw enough outside ambient air to effect proper combustion within the internal combustion engine. The separate room which houses the radiator may be cooled to a much greater extent by transporting a much higher volume of air therethrough to effect proper cooling of the internal combustion engine.

A problem with using a separate room for housing the radiator which is adjacent to the room for housing the internal combustion engine is that additional space is required which may not always be available. Additionally, the separate room for housing the radiator adds to the cost of the system.

The present invention is directed to overcoming one or more of the problems as set forth above.

DISCLOSURE OF THE INVENTION

In one aspect of the invention, a temperature control system includes an enclosure having a plurality of adjoining walls. An inlet louver assembly is disposed within one of the walls, and includes a plurality of inlet louvers. An outlet louver assembly is disposed within an other of the walls, and includes a plurality of movable outlet louvers. An actuator is coupled with the outlet louver assembly for moving the plurality of outlet louvers. An internal combustion engine is disposed within the enclosure. An ambient air temperature sensor is disposed within the enclosure for sensing an ambient air temperature within the enclosure and providing an output signal. An engine temperature sensor is coupled with the engine for sensing a temperature within the engine and providing an output signal. An electrical processing circuit is coupled with each of the ambient air temperature sensor, the engine temperature sensor and the actuator. The electrical processing circuit controls the actuator and thereby the movement of the plurality of outlet louvers dependent upon the output signal from each of the ambient air temperature sensor and the engine temperature sensor.

In another aspect of the invention, a temperature control system includes an enclosure having a plurality of adjoining walls. An inlet louver assembly is disposed within one of the walls, and includes a plurality of movable inlet louvers. An outlet louver assembly is disposed within an other of the walls, and includes a plurality of movable outlet louvers. An actuator is coupled with the outlet louver assembly for moving the plurality of outlet louvers. An internal combustion engine is disposed within the enclosure and includes a liquid coolant therein. A radiator is disposed within the enclosure and coupled with the liquid coolant in the engine. An air transport device such as a fan is disposed within the enclosure and moves air through the enclosure from the inlet louver assembly to the outlet louver assembly.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

BEST MODE FOR CARRYING OUT THE INVENTION

Figure 1:
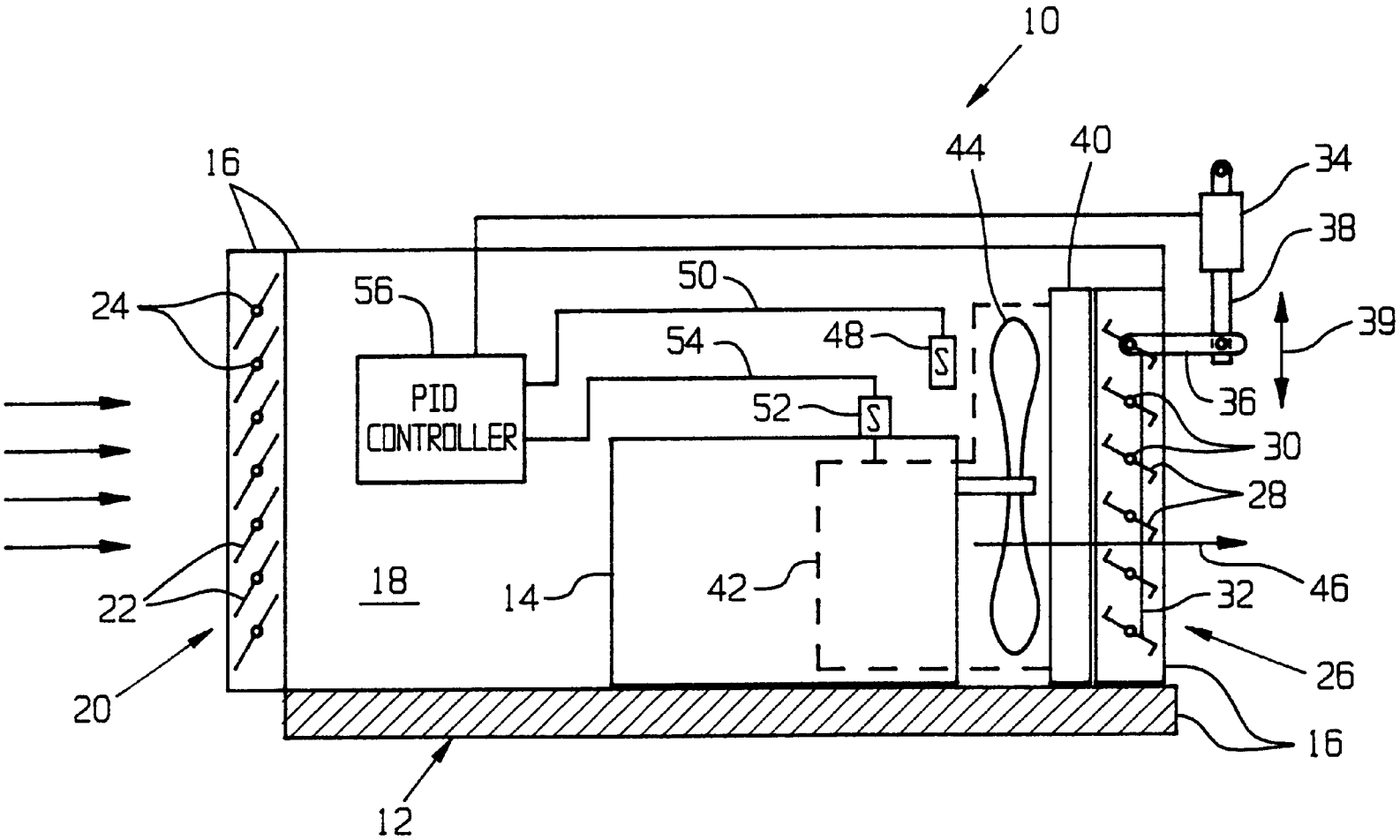
FIG. 1 is schematic view of an embodiment of the temperature control system of the present invention.

Referring now to the drawings, and more particularly to FIG. 1, there is shown an embodiment of a temperature control system 10 of the present invention for controlling the temperature within an enclosure 12 in which an internal combustion engine 14 is located.

Enclosure 12 includes a plurality of adjoining walls 16 defining an enclosed area in which an internal combustion engine 14 is disposed. Enclosure 12 may be, for example, a room which houses internal combustion engine 14, or an engine compartment in a motor vehicle which houses internal combustion engine 14. If enclosure 12 is in the form of a room 18 (FIG. 1), it may be desirable to regulate the ambient temperature within enclosure 12 to improve the operating performance of internal combustion engine 14 and/or to make room 18 within enclosure 12 more comfortable for operating personnel which also may be located therein.

An inlet louver assembly 20 is positioned in one of walls 16 and allows air from an outside ambient environment to be drawn into room 18 of enclosure 12. Inlet louver assembly 20 includes a plurality of inlet louvers 22 which extend in a direction perpendicular to the drawing of FIG. 1 and which are pivotally mounted at each end thereof using pivot pins 24. Pivot pins 24 on each louver 22 are positioned such that each louver 22 falls to a substantially closed position during periods of inoperation of internal combustion engine 14.

During periods of operation of internal combustion engine 14, air is drawn into room 18 of enclosure 12 and louvers 22 pivot to an open or partially open position.

An outlet louver assembly 26 is positioned in another wall 16 of enclosure 12. In the embodiment shown, outlet louver assembly 26 is positioned in a wall 16 substantially opposite from the wall in which inlet louver assembly 20 is disposed. Outlet louver assembly 26 includes a plurality of outlet louvers 28 which extend in a direction perpendicular to the drawing of FIG. 1 and which are pivotable about pivot pins 30 extending from each end of each outlet louver 28. Each outlet louver 28 is pivotally connected to a common shaft 32 which allows all of outlet louvers 28 to be simultaneously moved together.

An actuator in the form of an electric actuator 34 (or other suitable actuator) is connected with a pivot pin 30 of a top outlet louver 28 via a control arm 36. Control arm 36 is rigidly connected with pivot pin 30 of the top outlet louver 28, and is pivotally connected with a arm 38 of actuator 34. Ram 38 is moveable in opposite linear directions as indicated by double-headed arrow 39. Movement of ram 38 in a selected linear direction 39 causes rotational movement of control arm 36 which in turn causes rotational movement of each of outlet louvers 28. The extent to which outlet louvers 28 are opened and closed is controlled by the axial position of ram 38 of actuator 34.

Internal combustion engine 14 is disposed within room 18 of housing 12. Internal combustion engine 14 may be configured for any desired application suitable for operation within room 18. For example, internal combustion engine 14 may be part of an electrical generator set which is located in room 18 and which provides electrical power for a specific application. If internal combustion engine 14 is part of an electrical generator set, the electrical power generated thereby may be used for providing power at a construction site. Enclosure 12 may thus be in the form of a mobile trailer for such an application.

A radiator 40 is disposed within enclosure 12 and functions to cool liquid coolant which is circulated within liquid cooling channels 42 within internal combustion engine 14. Radiator 40 is sized and configured to provide adequate cooling of the liquid coolant within internal combustion engine 14, dependent upon the size and configuration of internal combustion engine 14.

An air transport device in the form of a fan 44 which is driven by internal combustion engine 14 is positioned at an inlet side of radiator 40, relative to a fluid flow direction 46. Fan 44 causes air from the outside ambient environment to be drawn through inlet louver assembly 20 into room 18 and exhausted to the outside ambient environment through outlet louver assembly 26. The air which is transported by fan 44 flows in a series manner through radiator 40 and subsequently through outlet louver assembly 26.

An ambient air temperature sensor 48 is disposed within room 18 of enclosure 12 and senses an ambient air temperature within room 18. In the embodiment shown, ambient air temperature sensor 48 is positioned at an inlet side of fan 44, relative to fluid flow direction 46. Air temperature sensor 48 provides an output signal over conductor 50 representing a value of the ambient air temperature within room 18.

An engine temperature sensor 52 is fluidly coupled with cooling channel 42 within internal combustion engine 14. Engine temperature sensor 52 senses a temperature of the liquid coolant within internal combustion engine 14 and provides an output signal over conductor 54 corresponding thereto. Engine temperature sensor 52 may be configured to provide an output signal regardless of the temperature of internal combustion engine 14 or may be configured to only provide an output signal when the temperature of the liquid coolant within internal combustion engine 14 reaches a maximum threshold temperature such as 200 F. In the embodiment shown, engine temperature sensor 50 provides an output signal representing a discrete temperature of the liquid coolant within internal combustion engine 14 at a particular point in time.

An electrical processing circuit which, in the embodiment shown, is in the form of a proportional-integral-differential (PID) controller 56 is coupled with actuator 34 and controls actuator 34 for adjusting the position of outlet louvers 28. PID controller 26 is also coupled with and receives input signals from ambient air temperature sensor 48 and engine temperature sensor 52 via conductors 50 and 54, respectively. During normal operation of temperature control system 10, PID controller 56 controls actuator 34 using output signals received from ambient air temperature sensor 48 indicating an ambient air temperature within room 18. Closing of outlet louvers 28 reduces the air flow through room 18 and in essence stalls the air flow generated by fan 44. Outlet louver assembly 26 is located on the downstream side of fan 44, relative to fluid flow direction 46, such that air flow through fan 44 is stalled rather than starved. If outlet louver assembly 26 was placed on the upstream side of fan 44, starvation of fan 44 would occur which may result in cavitation of the blades on fan 44. Such cavitation is undesirable. By placing outlet louver assembly 26 on the downstream side of fan 44, air flow through room 18 may be reduced to increase the temperature therein without resulting in cavitation of fan 44.

If ambient air temperature sensor 48 provides an output signal indicating that an ambient air temperature within room 18 is above a desirable level, outlet louvers 28 in outlet louver assembly 26 are opened a predetermined amount by controlling actuator 34 with PID controller 56. The extent to which outlet louvers 28 are opened or closed, dependent upon the output signal received from ambient air temperature sensor 48, may be a constant incremental amount or a proportional amount relative to the difference between a current received output signal and a previous received output signal.

Engine temperature sensor 52 also provides an output signal to PID controller 56 which basically acts as an interrupt signal during normal operation of temperature control system 10. If the output signal transmitted from engine temperature sensor 52 does not exceed a maximum threshold value (e.g., 200 F. water coolant temperature within internal combustion engine 14), then PID controller 56 controls actuator 34 using the output signals received from ambient air temperature sensor 48. On the other hand, if the output signal received from engine sensor temperature 52 indicates that the water coolant temperature within internal combustion engine 14 has exceeded a maximum threshold value, then PID controller 56 controls actuator 34 to open outlet louvers 28 to a full open position. This provides maximum cooling of internal combustion engine 14 to lower the temperature of a liquid coolant within internal combustion engine 14 to an acceptable temperature. When engine temperature sensor 52 provides an output signal indicating that a liquid coolant temperature is again within an accepted range, PID controller 56 controls actuator 34 using the output signals received from ambient air temperature sensor 48.

INDUSTRIAL APPLICABILITY

Figure 2:
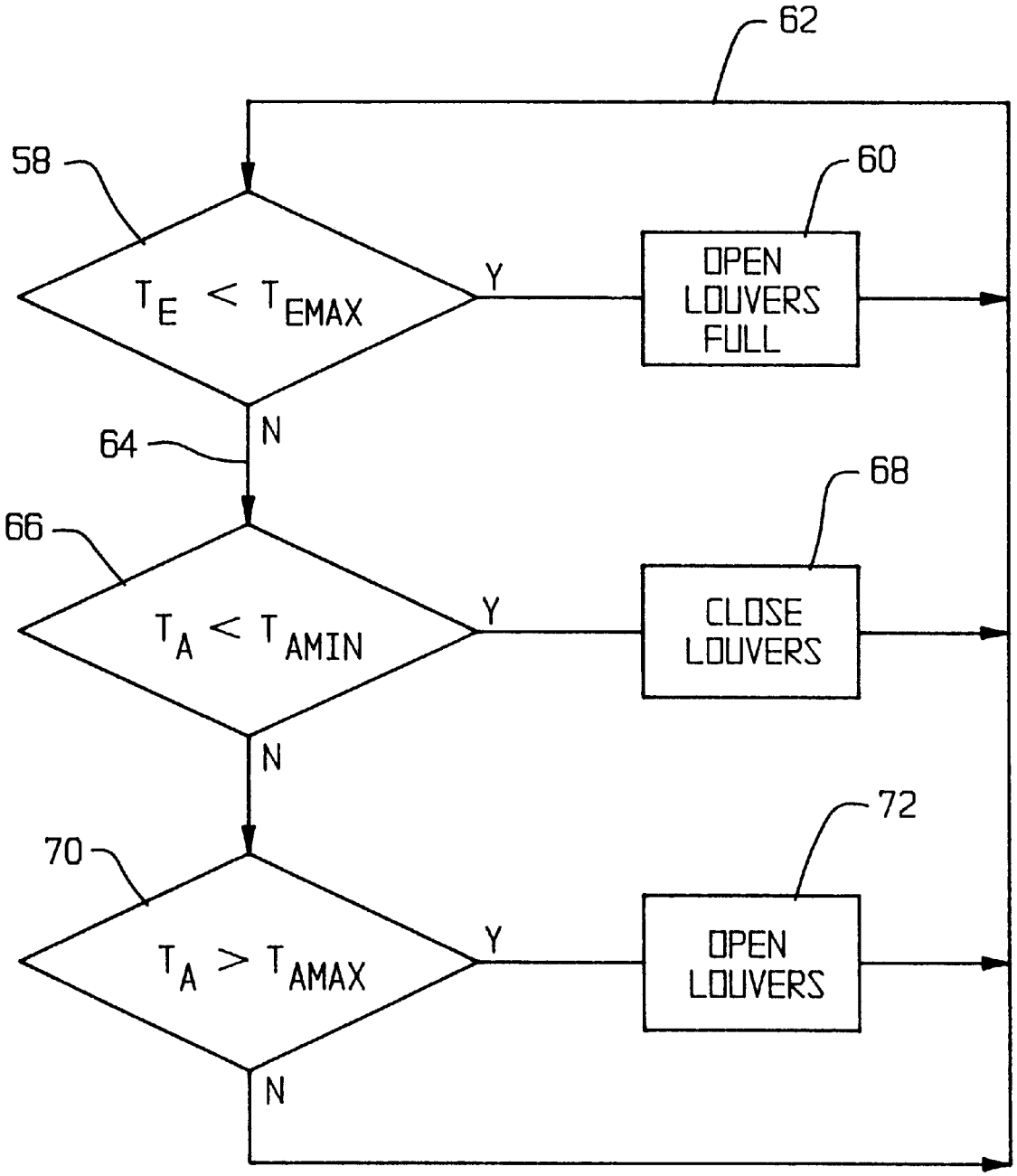
FIG. 2 is a flow chart illustrating a method of operation of the temperature control system of FIG.

With specific reference to FIG. 2, operation of temperature control system 10 shown in FIG. 1 will now be described. The flow chart of FIG. 2 is a simplified illustration of the feedback operation of temperature control system 10 and does not represent the entire control methodology during operation of internal combustion engine 14. For example, other control blocks corresponding to the operation of internal combustion engine 14 and/or the rotational speed of fan 44 are also likely used during operation of internal combustion engine 14.

As indicated above, engine temperature sensor 52 provides an output signal which is used as an interrupt signal or fail-safe signal during operation of internal combustion engine 14. At decision block 58, PID controller 56 compares the engine temperature $T_E$ with a maximum engine temperature $T_{EMAX}$ within PID controller 56. If the engine temperature $T_E$ is greater than the engine temperature $T_{EMAX}$, then PID controller 56 controls actuator 34 to move outlet louvers 28 to a full open position (block 60). This causes maximum cooling of internal combustion engine 14. Control then loops back to decision block 58 via line 62 and a wait state occurs during which outlet louvers 28 are maintained in a full open position until the engine temperature TE is less than a maximum threshold temperature $T_{EMAX}$.

If the engine temperature $T_E$ indicated by the output signal received from engine temperature sensor 52 is less than the maximum threshold temperature $T_{EMAX}$ (line 64), then the ambient temperature indicated by the output signal received from air temperature sensor 48 is compared with a minimum threshold ambient air temperature $T_{AMIN}$ (decision block 66). If the sensed ambient temperature $T_A$ is less than a minimum threshold ambient is air temperature $T_{AMIN}$, then outlet louvers 28 are closed an incremental or proportional amount to reduce the airflow through fan 44 and thereby increase the ambient air temperature within room 18 (block 68). Control then loops from block 68 to decision block 58 via line 62.

If the sensed ambient air temperature $T_A$ is greater than the minimum threshold ambient air temperature $T_{AMIN}$, then PID controller compares the sensed ambient air temperature $T_A$ with a maximum threshold ambient air temperature $T_{AMAX}$ (decision block 70). If the sensed ambient air temperature $T_A$ is not greater than the maximum threshold ambient air temperature $T_{AMAX}$ (indicating that the sensed ambient air temperature is within a desirable range), then outlet louvers are maintained at a current operational position and control passes back to decision block 58 via line 62. On the other hand, if the ambient air temperature $T_A$ is greater than the maximum threshold ambient air temperature $T_{AMAX}$, then the ambient air temperature within room 18 is hotter than desirable and outlet louvers 28 are opened an incremental or proportional amount to increase the air flow through room 18 and thereby cool room 18 (block 72). Control then passes back to decision block 58 via line 62.

The present invention allows the temperature within room 18 of enclosure 12 to be controlled within a desireable operating ambient temperature range, while at the same time still allowing fail-safe operation of internal combustion engine 14. If the temperature of the water coolant within internal combustion engine 14 exceeds a maximum threshold value, internal combustion engine 14 is cooled regardless of the ambient temperature within room 18 of enclosure 12. By placing the outlet louver assembly on the downstream side of fan 44, airflow induced by fan 44 is stalled rather than starved, thereby preventing cavitation of the blades on fan 44. The relative position of fan 44 and radiator 40 can be switched, as long as fan 44 is positioned on the upstream said of outlet louver assembly 26, relative to fluid flow direction 46. Temperature control system 10 of the present invention therefore provides effective control of the ambient temperature within room 18, fail-safe operation of internal combustion engine 14 due to overheat conditions, sudden changes in load or loss in PID control, and eliminates cavitation of the blades on fan 44.

Other aspects, objects and advantages of this invention can be obtained from a study of the drawings, the disclosure and the appended claims.

What is claimed is:

1. A temperature control system, comprising:

an enclosure having a plurality of adjoining walls;

an inlet louver assembly disposed within one of said walls, said inlet louver assembly including a plurality of movable inlet louvers;

an outlet louver assembly disposed within an other of said walls, said outlet louver assembly including a plurality of movable outlet louvers;

an actuator coupled with said outlet louver assembly for moving said plurality of outlet louvers;

an internal combustion engine disposed within said enclosure;

an ambient air temperature sensor disposed within said enclosure for sensing an ambient air temperature within said enclosure and providing an output signal;

an engine temperature sensor coupled with said engine for sensing an engine temperature within said engine and providing an engine temperature signal; and an electrical processing circuit coupled with each of said ambient air temperature sensor, said engine temperature sensor and said actuator, said electrical processing circuit variably controlling said actuator and thereby said movement of said plurality of outlet louvers dependent upon said output signal from said ambient air temperature sensor, said electrical processing circuit overriding said variable control of said actuator when said engine temperature signal exceeds a maximum threshold value and thereby causing said actuator to move said plurality of outlet louvers to a full, open position.

2. The temperature control system of claim 1, wherein said engine temperature sensor senses a temperature of cooling fluid within said engine.

3. The temperature control system of claim 1, wherein said engine includes a radiator for cooling a liquid within said engine, and wherein said ambient air temperature sensor is positioned at an inlet side of said radiator.

4. The temperature control system of claim 1, wherein said electrical processing circuit comprises an electrical controller.

5. The temperature control system of claim 4, wherein said electrical controller comprises a proportional-integral-derivative controller.

6. The temperature control system of claim 1, wherein said actuator comprises an electric actuator.

7. A temperature control system, comprising:

an enclosure having a plurality of adjoining walls;

an inlet louver assembly disposed within one of said walls, said inlet louver assembly including a plurality of inlet louvers;

an outlet louver assembly disposed within an other of said walls, said outlet louver assembly including a plurality of movable outlet louvers;

an actuator coupled with said outlet louver assembly for moving said plurality of outlet louvers;

an internal combustion engine disposed within said enclosure;

an ambient air temperature sensor disposed within said enclosure for sensing an ambient air temperature within said enclosure and providing a control signal;

an engine temperature sensor coupled with said engine for sensing an engine temperature within said engine and providing an engine temperature signal; and an electrical processing circuit coupled with each of said ambient air temperature sensor, said engine temperature sensor and said actuator, said electrical processing circuit controlling said actuator and thereby said movement of said plurality of outlet louvers dependent upon said control signal from said ambient air temperature sensor, said electrical processing circuit overriding said control signal when said engine temperature signal exceeds a maximum threshold value and thereby causing said actuator to move said plurality of outlet louvers into a full, open position.

8. A temperature control system, comprising:

an enclosure having a plurality of adjoining walls;

an inlet louver assembly disposed within one of said walls, said inlet louver assembly including a plurality of inlet louvers;

an outlet louver assembly disposed within an other of said walls, said outlet louver assembly including a plurality of movable outlet louvers;

an actuator coupled with said outlet louver assembly for moving said plurality of outlet louvers;

an internal combustion engine disposed within said enclosure;

an ambient air temperature sensor disposed within said enclosure for sensing an ambient air temperature within said enclosure and providing a control signal;

an engine temperature sensor coupled with said engine for sensing an engine temperature within said engine; and an electrical processing circuit coupled with each of said ambient air temperature sensor, said engine temperature sensor and said actuator, said electrical processing circuit variably controlling said actuator and thereby said movement of said plurality of outlet louvers dependent upon said control signal from said ambient air temperature sensor, said electrical processing circuit overriding said variable control when said engine temperature detected by said engine temperature sensor exceeds a maximum threshold value.

* * * * *